US006457790B1

(12) United States Patent
Liang et al.

(10) Patent No.: US 6,457,790 B1
(45) Date of Patent: Oct. 1, 2002

(54) FLEXIBLE STRIP FOR SLIDE RELEASE MECHANISM

(75) Inventors: Hsiu-Chiang Liang; Keng-Chin Chen; Chun-Chiang Wang, all of Kaohsiung (TW)

(73) Assignee: King Slide Works Co., Ltd., Kaohsiung (TW)

( * ) Notice: Subject to any disclaimer, the term of this patent is extended or adjusted under 35 U.S.C. 154(b) by 0 days.

(21) Appl. No.: 09/820,919

(22) Filed: Mar. 30, 2001

(30) Foreign Application Priority Data

Jan. 2, 2001 (TW) ..... 90200042 U

(51) Int. Cl.[7] ..... A47B 88/16
(52) U.S. Cl. ..... 312/334.46; 312/333
(58) Field of Search ..... 312/333, 334.44, 312/334.46; 384/21

(56) References Cited

U.S. PATENT DOCUMENTS 3,129,981 A * 4/1964 Meyer
3,589,778 A * 6/1971 Olson ..... 312/334.46 X
3,650,578 A * 3/1972 Del Vecchio et al. ..... 312/334.46 X
4,993,847 A 2/1991 Hobbs
4,998,828 A 3/1991 Hobbs
5,033,805 A * 7/1991 Hobbs ..... 312/334.46 X
5,085,523 A 2/1992 Hobbs
6,238,031 B1 * 5/2001 Weng ..... 312/334.46 X

* cited by examiner

*Primary Examiner*—Janet M. Wilkens
(74) *Attorney, Agent, or Firm*—Birch, Stewart, Kolasch & Birch, LLP

(57) ABSTRACT

A release mechanism for telescoping slide assembly including an outer member and an inner member is provided. The mechanism comprises a flexible strip of substantially triangular transverse cross section mounted on the inner member, the flexible strip including two flexible arms each extended from either end of a bottom plate thereof, two opposite recesses, and two locking lugs on the sides of either recess; and an engagement section on outer end of intermediate member, the section including an aperture and a projection on the edge of aperture. In the use position, the locking lugs contact the inner wall of the intermediate member while sliding, and the recesses are clung to both sides of the projection when the inner member has reached a predetermined end of the use position, thus blocking movement of the inner member relative to the intermediate member. Moreover, either arm may be depressed to disengage recess from projection. Hence, inner member may be moved away from outer member or retract inner member. The mechanism can effect a locking or unlocking of inner member in either extending or retracting.

3 Claims, 6 Drawing Sheets

FLEXIBLE STRIP FOR SLIDE RELEASE MECHANISM

BACKGROUND OF THE INVENTION

1. Field of Invention

The present invention relates to telescoping slide assembly and more particularly to a flexible strip for slide release mechanism with improved characteristics.

2. Related Art

Conventionally, a slide is widely employed to enable the relative movement of a drawer and a cabinet, a computer desk and a keyboard shelf, or the like. A conventional slide comprises an outer member, an intermediate member, and an inner member. For example in the drawer and cabinet configuration, outer member is fixed to the wall of cabinet, inner member is fixed to the side of drawer, and intermediate member is slidably received in outer member for supporting inner member in a sliding relationship. A well known ball bearing mechanism is employed to interconnect above any two adjacent members. Hence, inner member and intermediate member may coaxially move respect to outer member. Thus drawer is permitted to remove to its maximum extension or retract into the cabinet. Typically, a stop mechanism such as latch is employed to lock slide when it reaches its maximum extension. At this time, intermediate member and outer member are held in place by the latch. Hence, drawer carried by inner member is also held in this place. One such latch based release mechanism for slide assembly in cooperation with inner, intermediate, and outer members is disclosed in U.S. Pat. No. 4,998,828 entitled "Over And Under Telescoping Slide Assembly", which is incorporated herein by reference. In the '828 Patent, the slide assembly comprises a cabinet slide member, a drawer slide member, and an intermediate slide member slidably connected the cabinet inner member. A spring lock assembly is mounted on inner end of drawer slide member. A pair of hooks are provided at inner end of the intermediate slide member projected toward drawer slid e member. Spring lock assembly comprises a pair of flexible strips and a pair of receiving apertures. Hence, drawer slide member and its attached drawer may be sliding relative to the intermediate slide member when hooks are clear from the receiving apertures or depressing the flexible strips to disengage from the receiving apertures. However, such design does not block movement of drawer and drawer slide member while de pressing the flexible strips. Thus drawer is susceptible to drop from cabinet if enough care is not taken. The size of receiving aperture is enlarged for permitting the tab of flexible strip to have a sufficient time to fall into engagement therein since the sliding speed of slide may be fast. However, a gap between the receiving aperture and the tab of flexible strip is thus created. This is undesirable for securing drawer to cabinet.

Moreover, U.S. Pat. Nos. 4,993,847 and 5,085,523 both disclosed a similar slide release mechanism. In brief, a flexible strip is mounted on a first slide track fixed to a drawer. A button and a pin-receiving aperture are provided on flexible strip. A pin on a second slide track is activated to fall into the aperture when first slide track and its attached drawer are slid to a use position, thus locking the slide assembly in the use position. In a reverse operation, user may depress button to deform flexible strip for disengaging pin from the aperture. As a result, drawer may be retracted into or removed from cabinet. Such prior art is disadvantageous for employing many small components. Further, it does not block movement of drawer and first slide track while depressing the flexible strip. Thus drawer is susceptible to drop from cabinet if enough care is not taken.

SUMMARY OF THE INVENTION

It is therefore an object of the present invention to provide a release mechanism for slide assembly capable blocking movement of inner member and its attached drawer in either extending or retracting, thus ensuring a secure operation.

It is another object of the present invention to provide a precisely positioned release mechanism having reduced components.

The advantages of the present invention are realized by providing a release mechanism for telescoping slide assembly including an outer member and an inner member is provided. The mechanism comprises a flexible strip of substantially triangular transverse cross section mounted on the inner member, the flexible strip including two flexible arms each extended from either end of a bottom plate thereof, two opposite recesses, and two locking lugs on the sides of either recess; and an engagement section on outer end of intermediate member, the section including an aperture and a projection on the edge of aperture. In the use position, the locking lugs contact the inner wall of the intermediate member while sliding, and the recesses are clung to both sides of the projection when the inner member has reached a predetermined end of the use position, thus blocking movement of the inner member relative to the intermediate member. Moreover, either arm may be depressed to disengage recess from projection. Hence, inner member may be moved away from outer member or retract inner member. The mechanism can effect a locking or unlocking of inner member in either extending or retracting.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
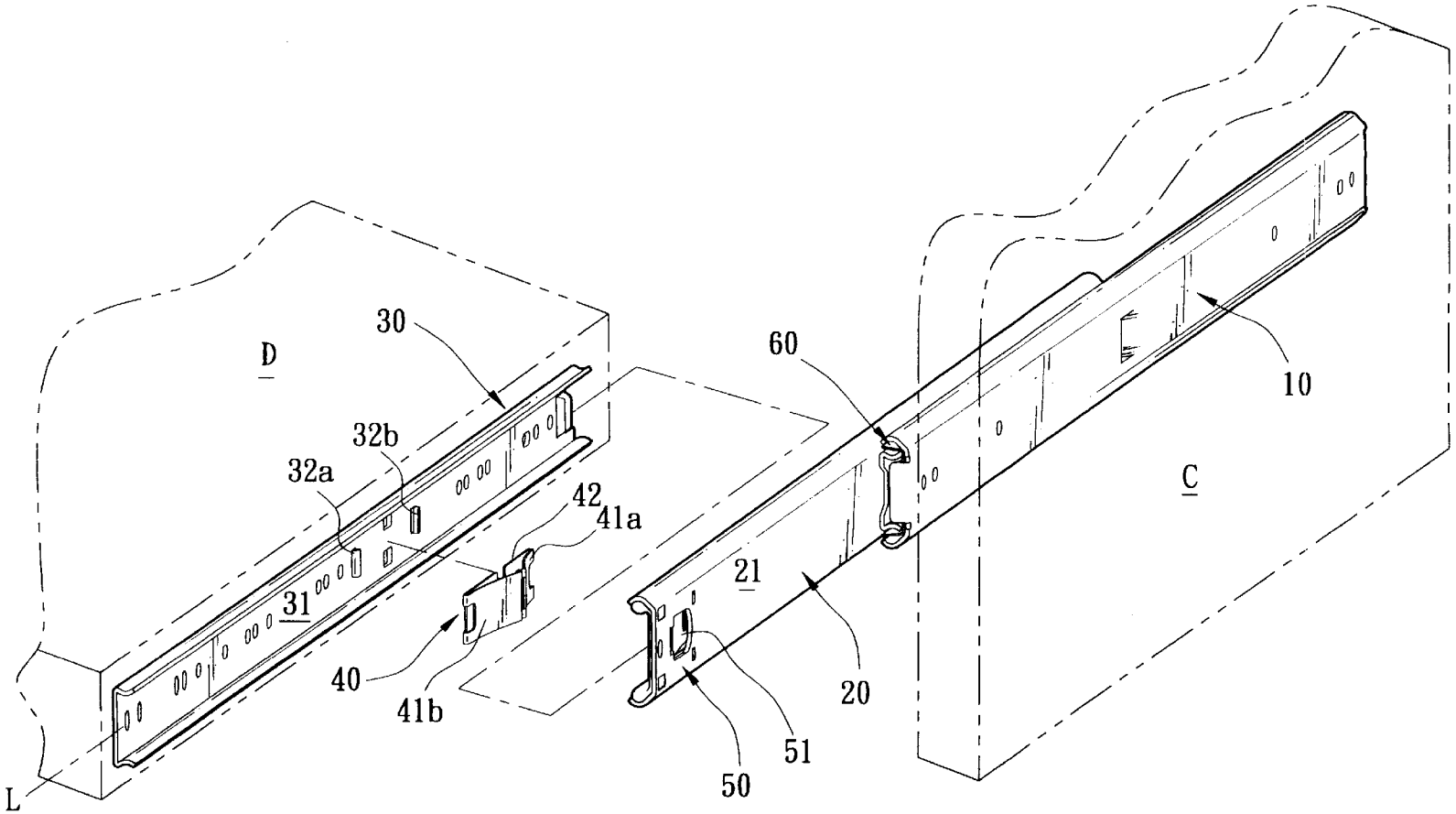
FIG. 1 is an exploded perspective view of a first preferred embodiment of slide assembly incorporating a flexible strip based release mechanism according to the invention.
Figure 2:
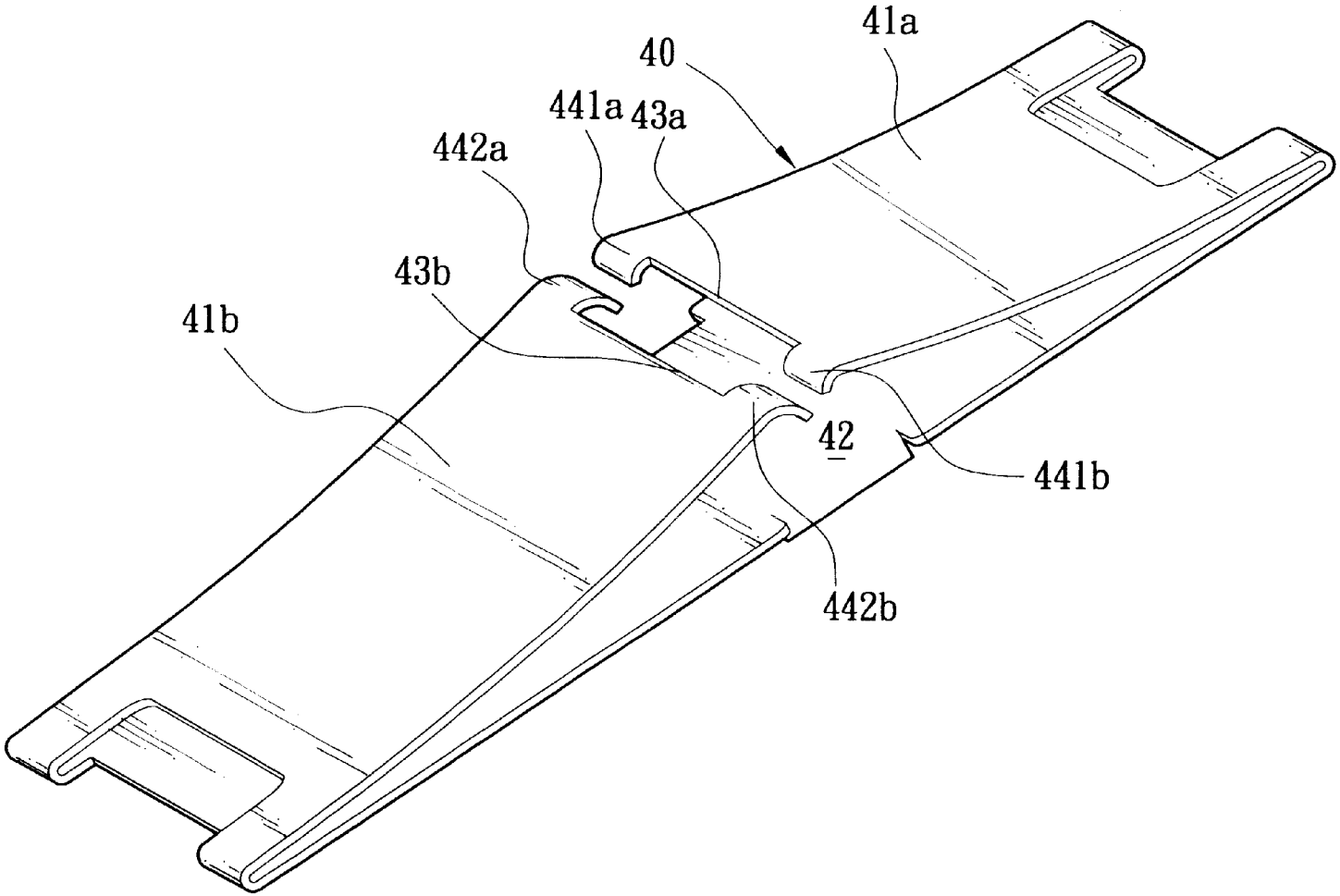
FIG. 2 is a perspective view of the flexible strip of FIG. 1.
Figure 3A:
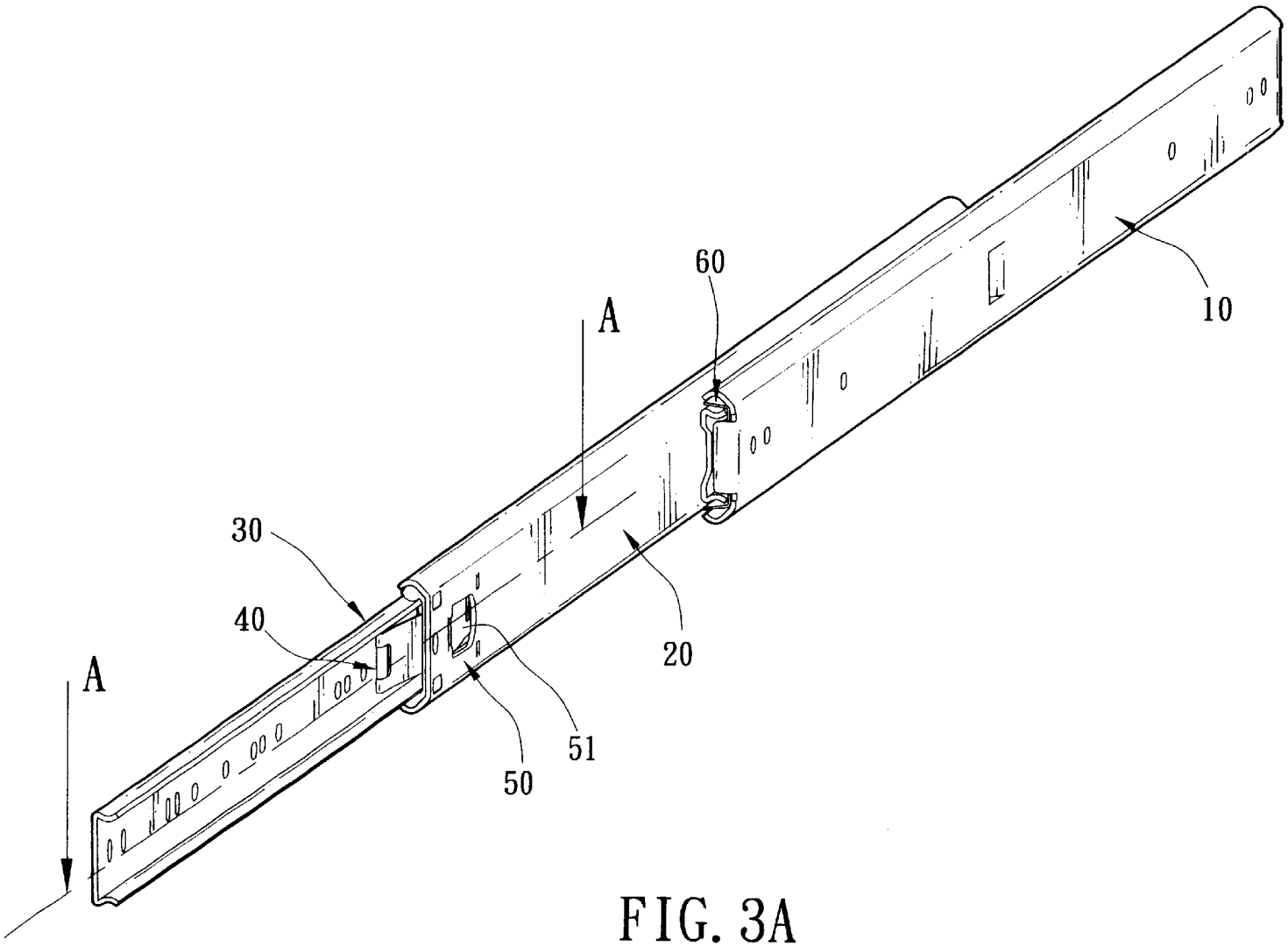
FIG. 3A is a perspective view of slide assembly with slide in a use position illustrating an engagement of flexible strip and engagement section.
Figure 3B:
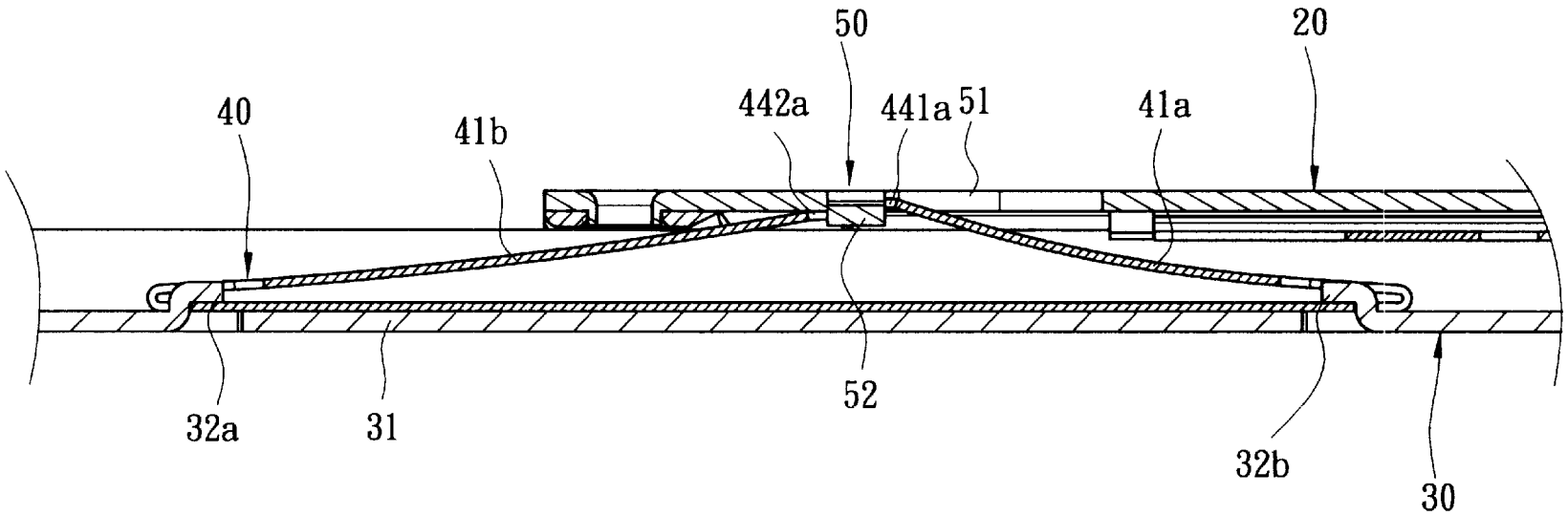
FIG. 3B is a sectional view taken along line A—A of FIG. 3A.

Referring to FIGS. 1 to 3, there is shown a slide assembly constructed in accordance with the invention comprising an outer member 10, an intermediate member 20, and an inner member 30. These members may may coaxially lengthwise slide one another. This embodiment is implemented in a drawer (or desk) C and a cabinet (or keyboard shelf) D combination wherein two pair of slides are provided on sides of drawer (or keyboard shelf) D to effectuate a relative sliding movement therebetween. Outer member 10 is affixed to the wall of cabinet (or desk) C. Inner member 30 is affixed to either side of drawer D. Intermediate member 20 is slidably received in outer member 10 for supporting inner member 30 in a sliding relationship. Typically, a ball bearing mechanism (e.g., ball bearings 60) is employed to interconnect above any two adjacent members. Hence, inner member 30 and intermediate member 20 may coaxially slide respect to outer member 10. When drawer D is pulled out to its maximum extension, slide is also extended. At this position, intermediate member 20 and outer member 10 are locked and held in place by a stop (i.e., release) mechanism. When the release mechanism is released, intermediate member 20 is free to move inwardly until drawer D is completely received in cabinet (or desk) C. The components of the release mechanism of the invention are as follows:

Flexible strip 40 is of substantially triangular transverse cross section. Flexible strip 40 is mounted on inner wall 31 of inner member 30 by riveting, welding, or threadedly securing. Preferably, flexible strip 40 is a one-piece metal (e.g., steel) stamping. Further, a pair of opposite tabs 32*a* and 32*b* are formed by punching on inner wall 31 of inner member 30. Thus, two ends of bottom plate 42 of flexible strip 40 may be clung to tabs 32*a* and 32*b* respectively, thus securing flexible strip 40 to inner wall 31 of inner member 30. Engagement section 50 is provided on the outer end of intermediate member 20. Engagement section 50 comprises an aperture 51 through inner wall 21 of intermediate member 20 and a tab 52 on the edge of aperture 51 (FIG. 3B). Flexible strip 40 further comprises a first flexible arm 41*a*, a spaced second flexible arm 41*b* each of both extended from either end of bottom plate 42 of flexible strip 40, a pair of opposite recesses 43*a* and 43*b*, a pair of locking lugs 441 a and 441 b on the sides of recess 43*a*, and a pair of locking lugs 442*a* and 442*b* on the sides of recess 43*b* wherein each of locking lugs 441*a*, 441*b*, 442*a* and 442*b* is bent toward the bottom plate 42 of flexible strip 40. It is designed that flexible strip 40 and its secured inner member 30 may slide to a use, retracted, or fully extended position. In the use position, recesses 43*a* and 43*b* are biased outward by the elasticity provided by first and second arms 41 a and 41 b. Further, locking lugs 441*a*, 441*b*, 442*a* and 442*b* contact the inner wall 21 of intermediate member 20 while sliding inner member 30. Recesses 43*a* and 43*b* are clung to both sides of tab 2 of engagement section 50 when inner member 30 has reached the predetermined end of the use position, thus blocking further movement of inner member 30 relative to intermediate member 20 (FIG. 3B). Moreover, user may depress first or second arm 41*a* or 41*b* to disengage recess 43*a* or 43*b* from tab 52 of engagement section 50. Hence, user further move inner member 30 away from outer member 10 or retract inner member 30 along intermediate member 20 to a retracted position. Thus a release mechanism for effecting a locking (or unlocking) of inner member 30 in either of two opposite directions (i.e., extending or retracting) is implemented.

Figure 4A:
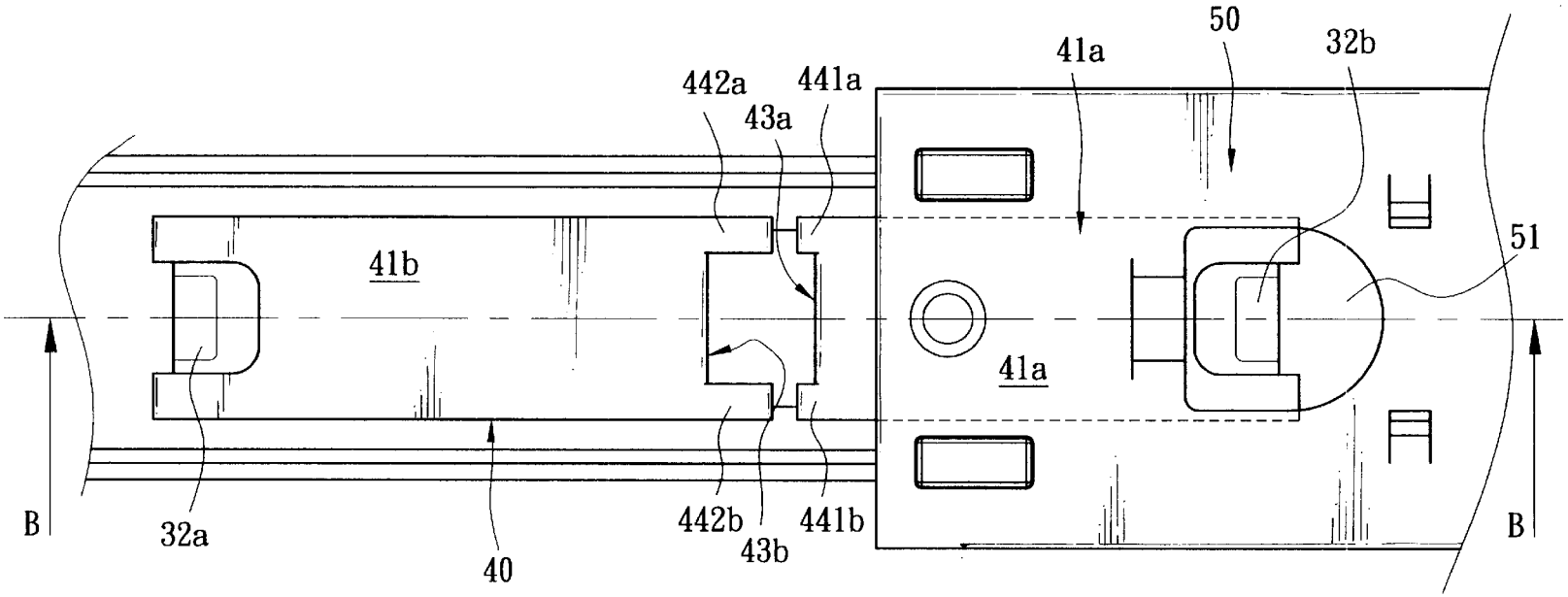
FIG. 4A is a side view illustrating the disengagement of flexible strip and engagement section when slide is extending after first arm is depressed.
Figure 4B:
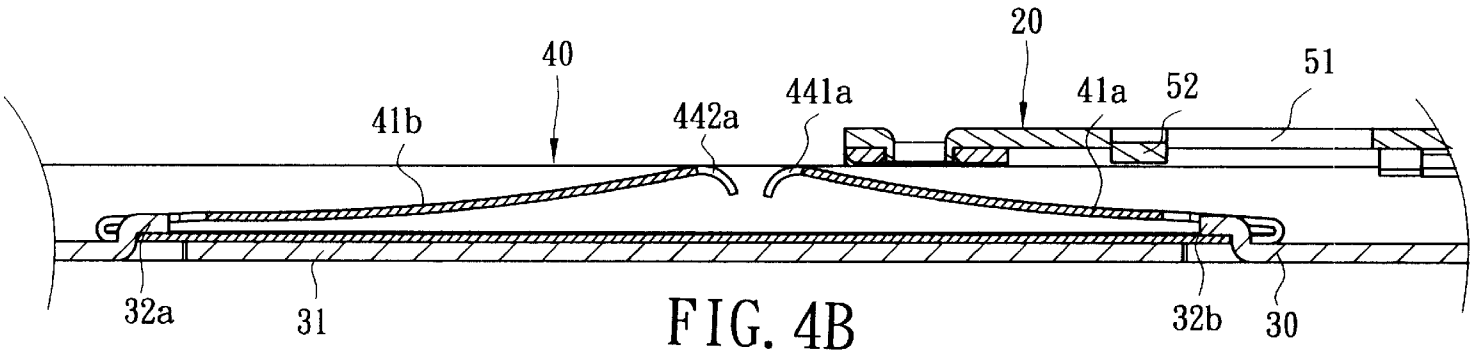
FIG. 4B is a sectional view taken along line B—B of FIG. 4A.
Figure 5A:
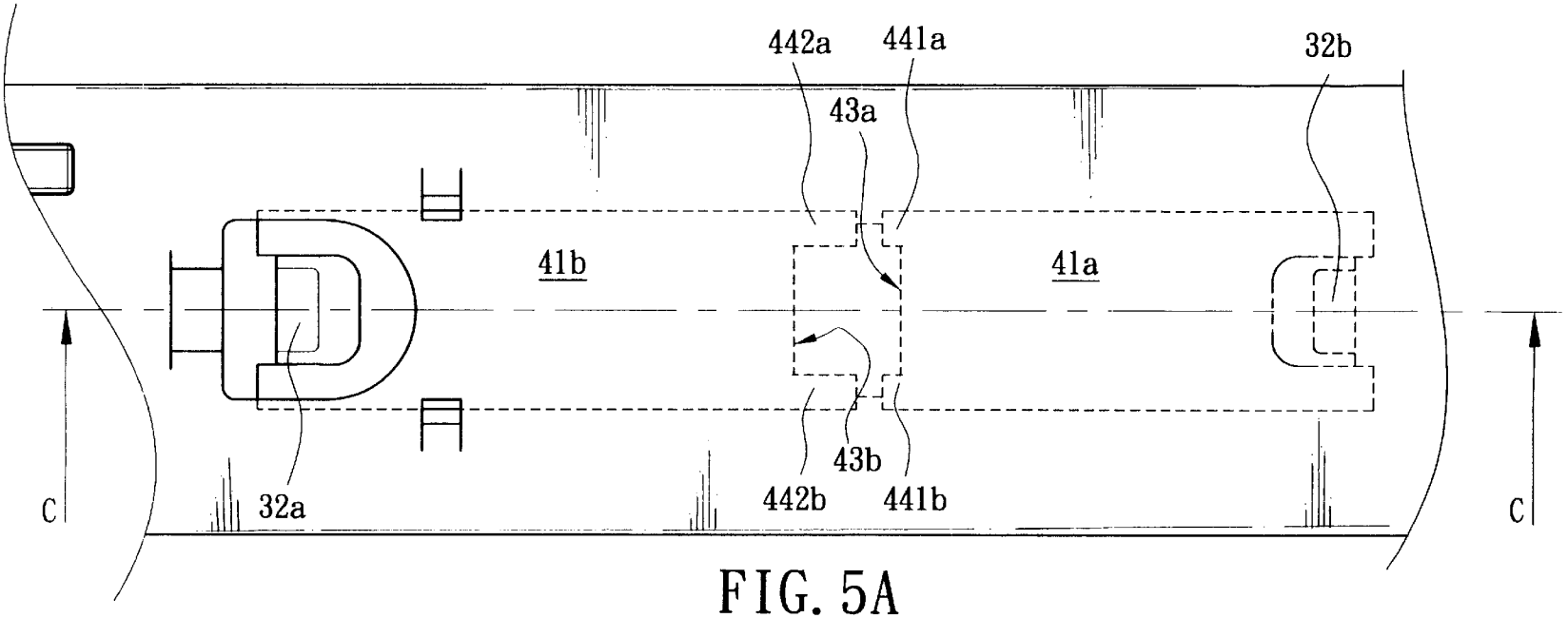
FIG. 5A is a side view illustrating the disengagement of flexible strip and engagement section when slide is retracting after second arm is depressed.
Figure 5B:
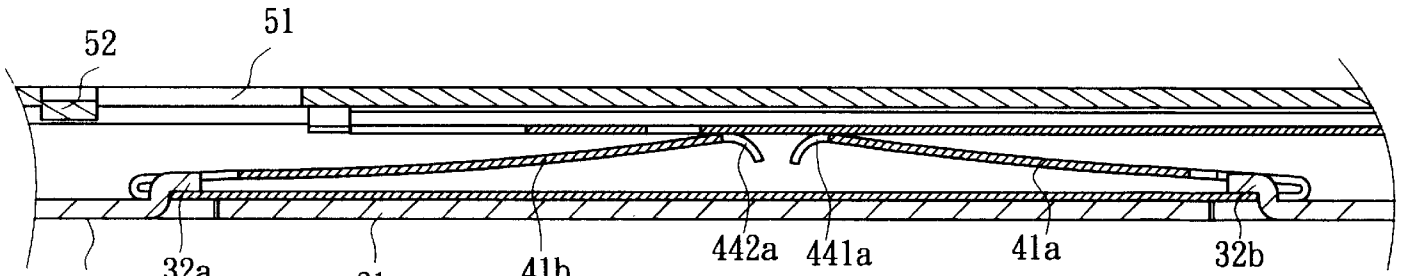
FIG. 5B a sectional view taken along line C—C of FIG. 5A.

Referring to FIGS. 4A and 4B, user may depress first arm 41*a* through aperture 51 to unlock tab 52. Then slide inner member 30 toward the out end for removing inner member 30 and its attached drawer (or keyboard shelf) D from cabinet. Referring to FIGS. 5A and SB, user may depress second arm 41*b* in order to retract inner member 30.

In view of above, it is possible for the invention to effecting a locking (or unlocking) of inner member in either extending or retracting, thus ensuring a secure operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A release mechanism for a telescoping slide assembly including an outer member, an intermediate member and an inner member, said mechanism comprising:

a flexible strip of substantially triangular transverse cross section mounted on said inner member, said flexible strip including a bottom plate, a first flexible arm, a spaced second flexible arm, both the first and second arms being extended from either end of said bottom plate, a pair of opposite recesses, a pair of first locking lugs on sides of one of the recesses, and a pair of second locking lugs on said sides of said other recess wherein in a use position, said recesses are elasticity biased outward by said first and said second arms; and an engagement section situated on an outer end of said intermediate member, said engagement section including an aperture through an inner wall of said intermediate member and a projecting member on an edge of said aperture;

wherein in said use position, said first and said second locking lugs contact said inner wall of said intermediate member while sliding said inner member, and said recesses are locked to both sides of said projecting member of said engagement section when said inner member has reached a predetermined end-of said use position, thus blocking movement of said inner member relative to said intermediate member.

2. The release mechanism of claim 1, further comprising a pair of opposite tabs on an inner wall of said inner member locked to said bottom plate of said flexible strip, thus securing said flexible strip to said inner wall of said inner member.

3. The release mechanism of claim 1, wherein said flexible strip is a one-piece steel stamping.

* * * * *